US008970330B2

(12) United States Patent
Wu et al.

(10) Patent No.: US 8,970,330 B2
(45) Date of Patent: Mar. 3, 2015

(54) CONTACTOR

(71) Applicant: Kunshan Vic Electronics Co., Ltd., Kunshan (CN)

(72) Inventors: Zhiming Wu, Kunshan (CN); Yihan Xu, Kunshan (CN); John Bin Zhan, Kunshan (CN)

(73) Assignee: Kunshan Vic Electronics Co., Ltd., Kunshan (CN)

( * ) Notice: Subject to any disclaimer, the term of this patent is extended or adjusted under 35 U.S.C. 154(b) by 0 days.

(21) Appl. No.: 14/032,189

(22) Filed: Sep. 19, 2013

(65) Prior Publication Data

US 2014/0077905 A1 Mar. 20, 2014

(51) Int. Cl.

| | |
|---|---|
| ***H01H 67/02*** | (2006.01) |
| ***H01H 3/02*** | (2006.01) |
| ***H01H 3/06*** | (2006.01) |
| ***H01H 3/28*** | (2006.01) |
| ***H01H 3/56*** | (2006.01) |
| ***H01H 11/00*** | (2006.01) |
| *H01H 50/00* | (2006.01) |

(52) U.S. Cl.

CPC . *H01H 3/02* (2013.01); *H01H 3/06* (2013.01); *H01H 3/28* (2013.01); *H01H 3/56* (2013.01); *H01H 11/0006* (2013.01); *H01H 50/002* (2013.01)

USPC ..... 335/131; 335/132

(58) Field of Classification Search

USPC ..... 335/131

See application file for complete search history.

(56) References Cited

U.S. PATENT DOCUMENTS

| | | | | |
|---|---|---|---|---|
| 3,611,215 | A * | 10/1971 | Patel | 335/20 |
| 4,990,875 | A * | 2/1991 | Lemarquand et al. | 335/131 |
| 7,619,376 | B2 * | 11/2009 | Hiroe et al. | 318/2 |
| 7,623,010 | B2 * | 11/2009 | Liu | 335/6 |
| 2003/0034242 | A1 * | 2/2003 | Mori et al. | 200/400 |
| 2006/0049026 | A1 * | 3/2006 | Weister et al. | 200/50.17 |
| 2007/0126538 | A1 * | 6/2007 | Liu | 335/172 |
| 2007/0138143 | A1 * | 6/2007 | Muench et al. | 218/1 |
| 2007/0267283 | A1 * | 11/2007 | Hiroe et al. | 200/179 |
| 2010/0060469 | A1 * | 3/2010 | Hetzmannseder et al. | 340/639 |
| 2010/0122967 | A1 * | 5/2010 | Morita et al. | 218/140 |
| 2012/0038438 | A1 * | 2/2012 | Sawada et al. | 335/6 |
| 2012/0132508 | A1 * | 5/2012 | Cyuzawa | 200/405 |
| 2012/0273332 | A1 * | 11/2012 | Rust | 200/276 |

* cited by examiner

*Primary Examiner* — Shawki S Ismail
*Assistant Examiner* — Lisa Homza
(74) *Attorney, Agent, or Firm* — Snell & Wilmer L.L.P.

(57) ABSTRACT

A contactor is disclosed. The contactor includes one or more phase units, a mechanical drive and an electronic control module. Each phase unit includes an independent insulating housing, and, inside the housing, a positive pole, a static conducting rod, a negative pole, a moving conducting rod and a counter-force elastic component. The electronic control module drives a transmission to move, the transmission drives the central shaft to rotate, the central shaft drives the engagement between the moving conducting rod and the static conducting rod, the central shaft passes through the insulating housings of the one or more phase units and drives each phase unit, so that the contactor can be formed by absolutely independent phase units and it is convenient to add a phase unit along the central shaft so as to add rated operational current.

9 Claims, 8 Drawing Sheets

CONTACTOR

FIELD OF THE INVENTION

The present invention relates to the field of switch device, and particularly, to a contactor.

BACKGROUND OF THE INVENTION

A contactor is a breaking and closing device for frequently closing, carrying and breaking normal current and overloaded current. It is applied on electric power, power distribution and power applications. In electric engineering, since a contactor can quickly disconnect the AC and DC main circuits and connect an apparatus to a large current control circuit, contactors are often used for controlling motors, also used for controlling electrical loads, such as factory equipment, electric heaters, machine tools and a variety of electric power phase units. A contactor not only can close and break a circuit but also has a protective effect on low-voltage release. The contactor has a large control capacity, and is adapted to frequent operation and remote control, therefore it is one of the important components in automatic control systems. When used in different situations, contactors with different rated operational currents are needed. However, the insulating housings of all the phases of a traditional contactor are integral to each other, not absolutely independent from each other, so that it is impossible to improve the rated operational current of the contactor by increasing parallel connections.

SUMMARY OF THE INVENTION

The object of the present invention is to provide a contactor which has phases absolutely independent from each other and facilitates to increase rated operational current.

The present invention provides a contactor including one or more phase units, a mechanical drive controlling the one or more phase units and an electronic control module for driving the mechanical drive, wherein each phase unit comprises an independent insulating housing, and, inside the housing, a positive pole, a static conducting rod connected to the positive pole, a negative pole, a moving conducting rod connected to the negative pole and a counter-force elastic component for driving the moving conducting rod to reset; the mechanical drive comprises a central shaft which passes through the insulating housings of the one or more phase units and drives all the moving conducting rods to electrically contact the static conducting rod, and a transmission which controls the rotation of the central shaft; the electronic control module drives the transmission.

Preferably, in one embodiment, the transmission includes a drive rod driving the central shaft to rotate and a magnetic pole core movably connected to the drive rod. The electronic control module includes an inductance coil driving the magnetic pole core to perform straight reciprocating motion.

Preferably, in one embodiment, the inductance coil drives the magnetic pole core to perform straight reciprocating motion in horizontal direction. The magnetic pole core drives the drive rod to swing side to side. The drive rod drives the central shaft to rotate either clockwise or anticlockwise within a pre-set angle.

Preferably, in one embodiment, the electronic control module also includes a first fixing plate and a second fixing plate which is disposed opposite the first fixing plate. The inductance coil is disposed between the first and second fixing plates, and the magnetic pole core passes through the second fixing plate and is inserted in the inductance coil.

Preferably, in one embodiment, a recess is located in an end of the magnetic pole core. A joint which is movable in the recess is provided at one end of the drive rod, and the other end of the drive rod is fastened to the central shaft.

Preferably, in one embodiment, the central shaft is provided with a tooth-like portion. The tooth-like portion has a tooth face capable of floating with the rotation of the central shaft. The phase unit also includes a spring chamber provided with a tooth. The tooth-like portion of the central shaft cooperates with the tooth and drives the spring chamber to float. The spring chamber is connected to the moving conducting rod and drives the moving conducting rod to float.

Preferably, in one embodiment, the counter-force elastic component is a counter-force spring. One end of the counter-force spring contacts with the insulating housing. The other end of the counter-force spring contacts with a hook portion extending from the spring chamber. The hook portion is able to compress the counter-force spring and reset when the counter-force spring bounces.

Preferably, in one embodiment, the contactor includes a plurality of phase units. The central shaft passes through every phase units. The mechanical drive is provided with drive rods and magnetic pole cores respectively corresponding to each of the phase units. The electronic control module is provided with inductance coils respectively corresponding to each of the magnetic pole cores.

Preferably, in one embodiment, the contactor also includes a base. The phase units are mounted on the base, and the electronic control module is mounted on the base and located on one side of the phase units.

Preferably, in one embodiment, the plurality of phase units form a three-phase contactor, and each phase includes at least two phase units connected in parallel.

In the above-mentioned contactor, the electronic control module drives the transmission to move, the transmission drives the central shaft to rotate, the central shaft drives the moving conducting rod and the static conducting rod to be attracted together, and the central shaft passes through the insulating housing(s) of the one or more phase units and is able to drive each of the phase units, such that the contactor can be formed by absolutely independent phase units and convenient to increase the rated operational current thereof by adding phase units along the central shaft.

DETAILED DESCRIPTION OF THE PREFERRED EMBODIMENTS

Figure 1:
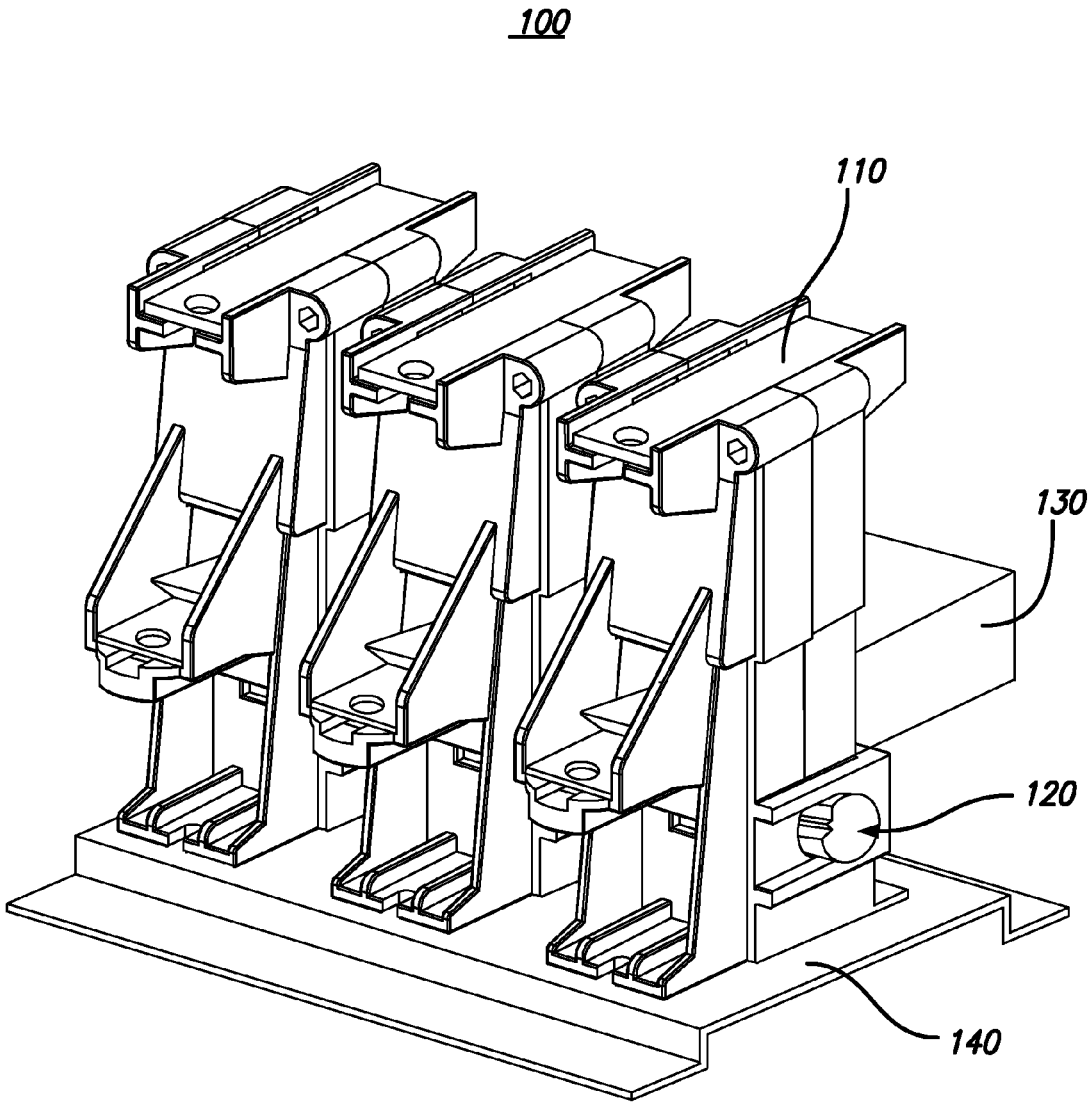
FIG. 1 shows a perspective view of a contactor according to an embodiment of the present invention.
Figure 2:
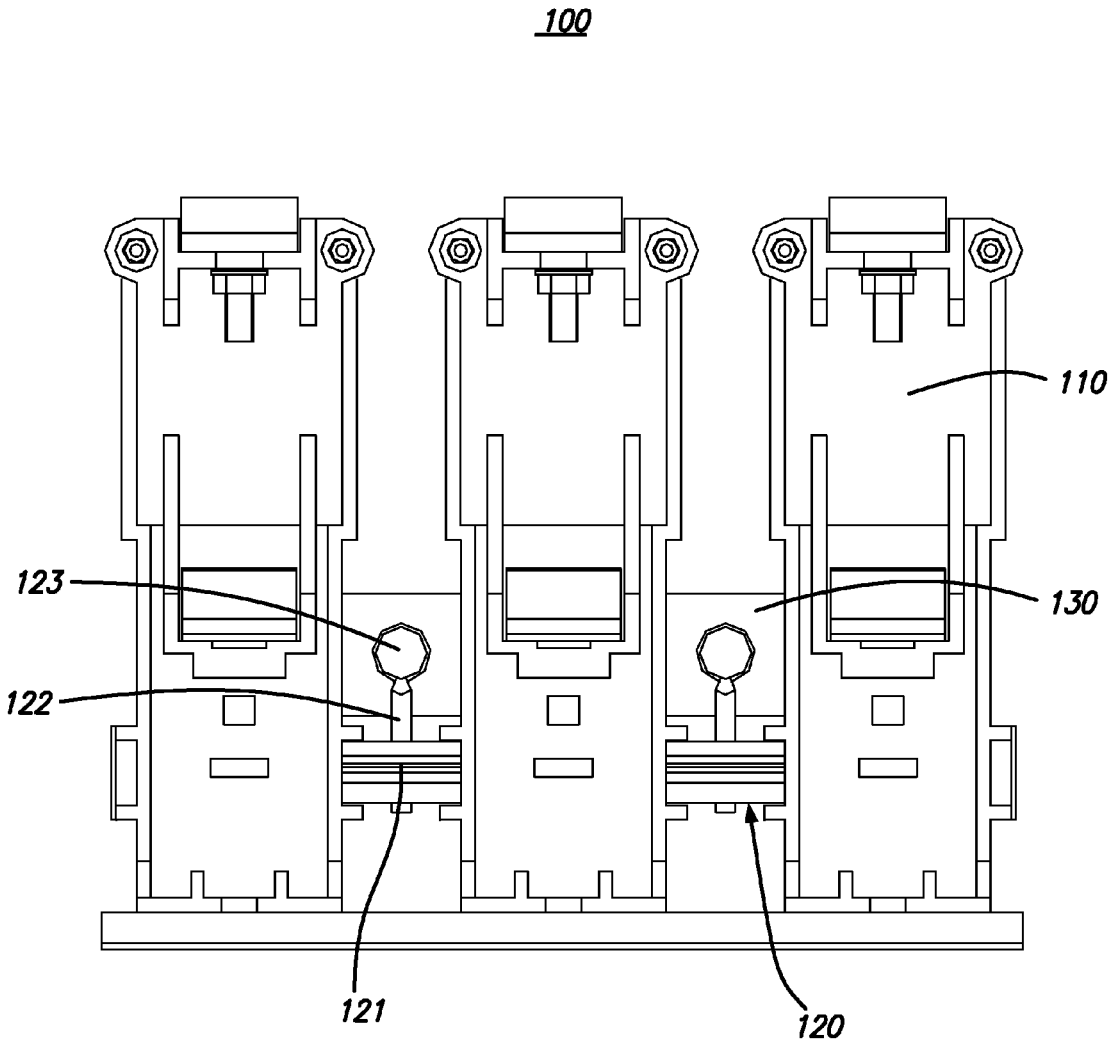
FIG. 2 shows a view of the contactor of FIG. 1 from another angle.
Figure 3:
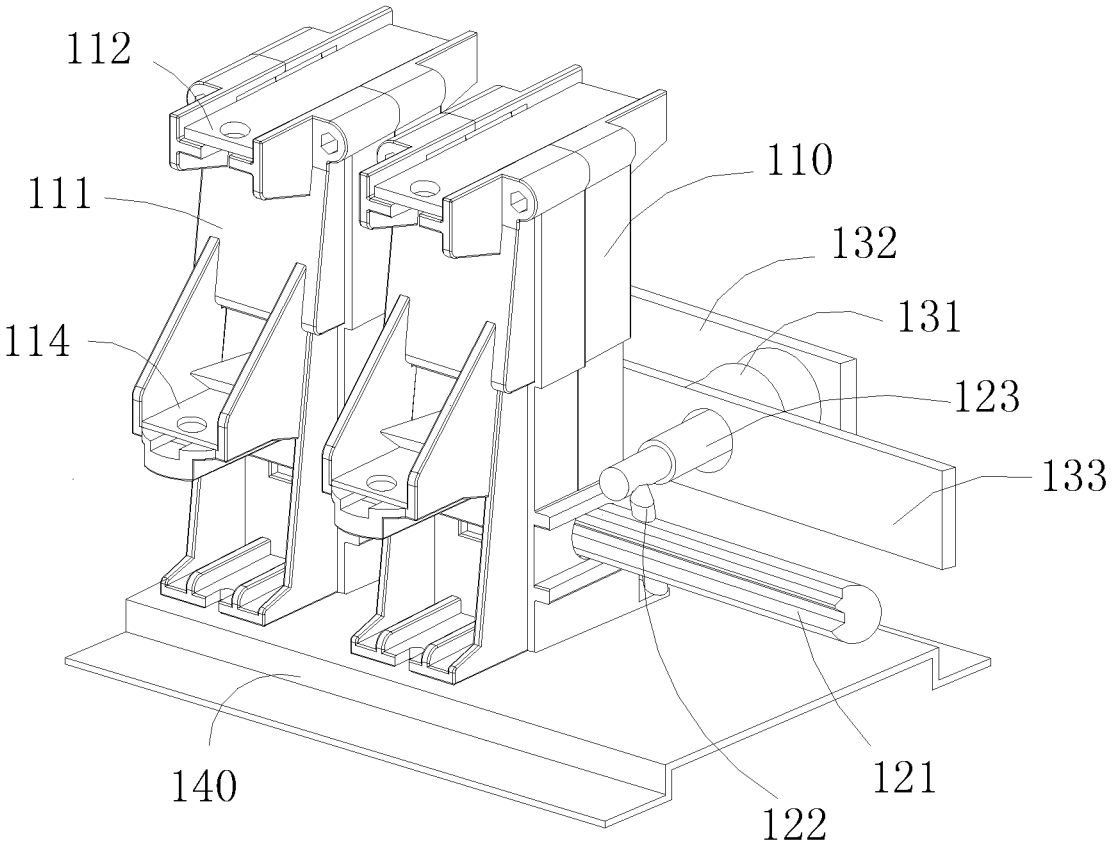
FIG. 3 shows a perspective view of part of a contactor according to an embodiment of the present invention.
Figure 4:
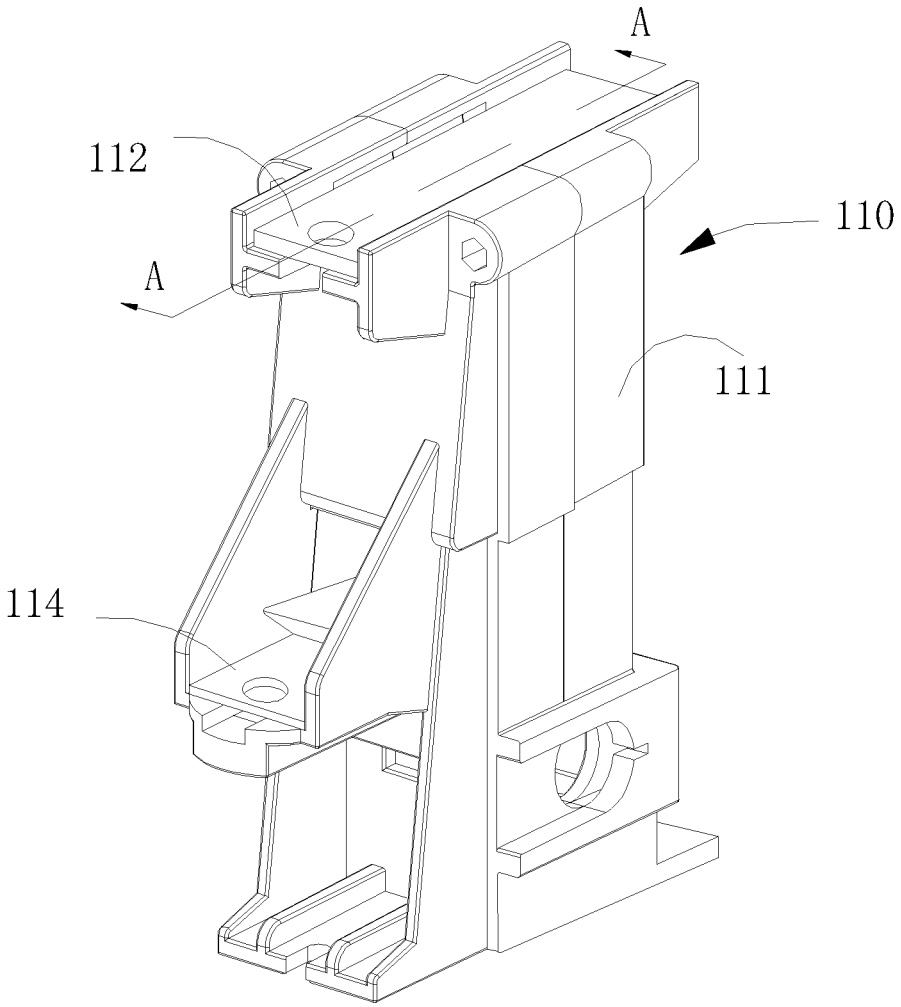
FIG. 4 shows a perspective view of a phase unit according to an embodiment of the present invention.
Figure 5:
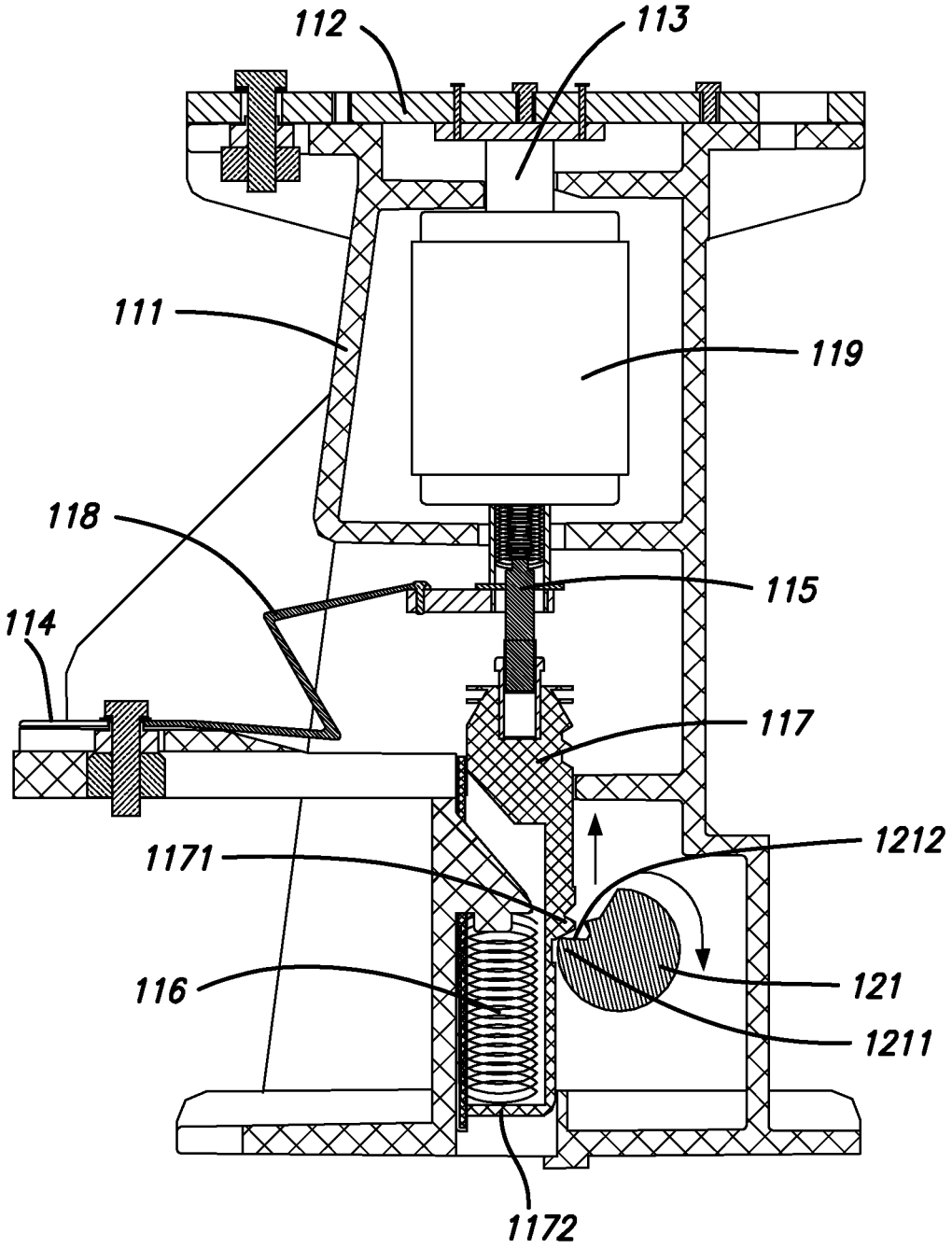
FIG. 5 shows a section view of the phase unit of FIG. 4, inserted with a central shaft and along the line A-A, wherein the static conducting rod contacts with the moving conducting rod.
Figure 6:
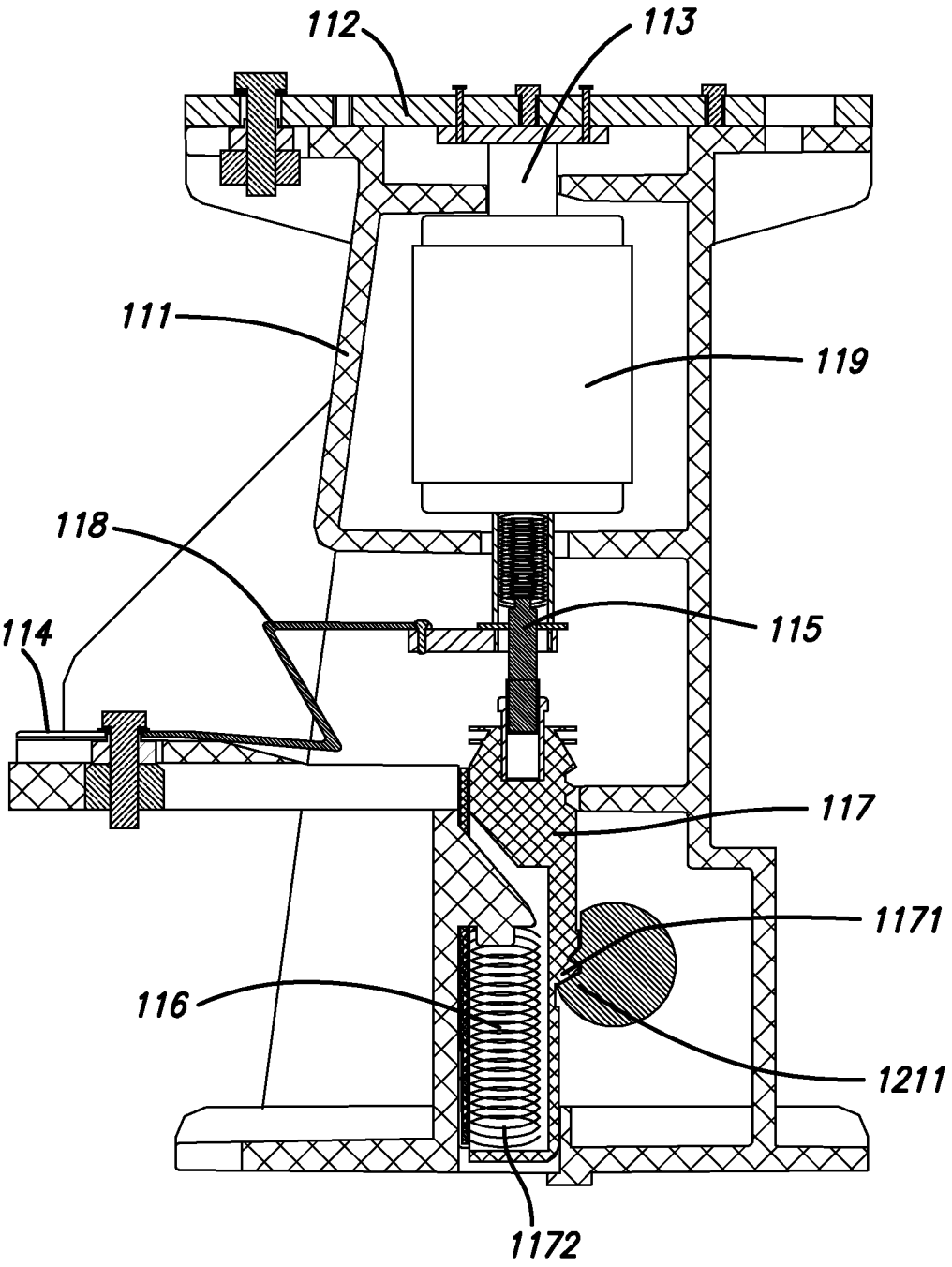
FIG. 6 shows a section view of the phase unit of FIG. 5, wherein the static conducting rod is broken from the moving conducting rod.
Figure 7:
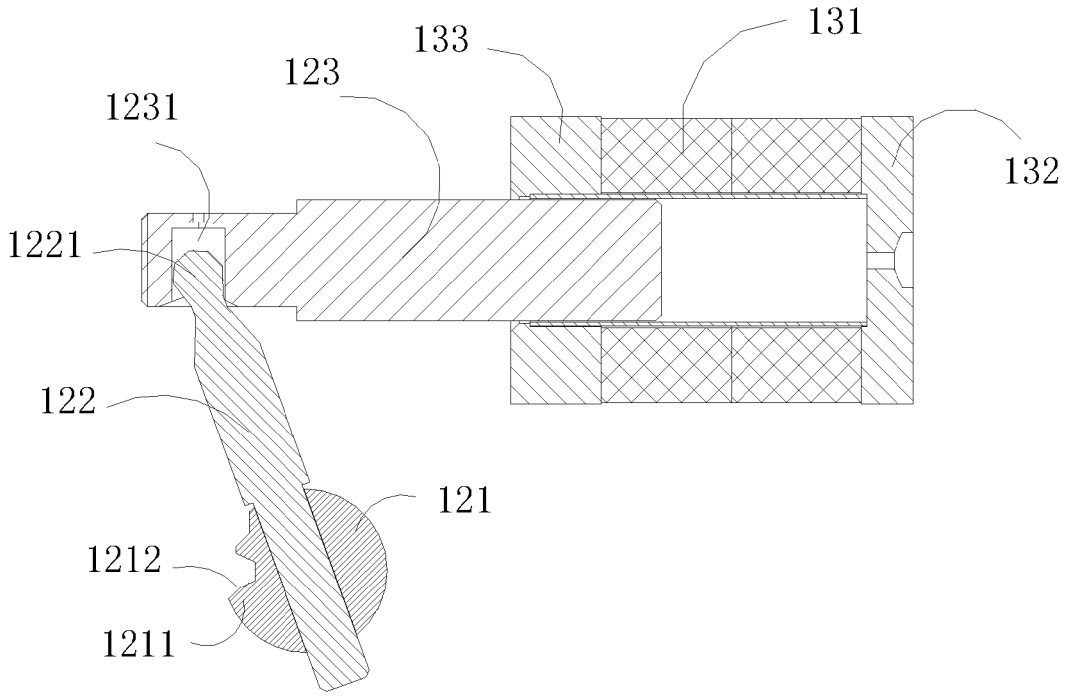
FIG. 7 is a schematic diagram of a contactor according to an embodiment of the present invention, wherein the mechanical drive and the electronic control module is in an initial state of cooperation.
Figure 8:
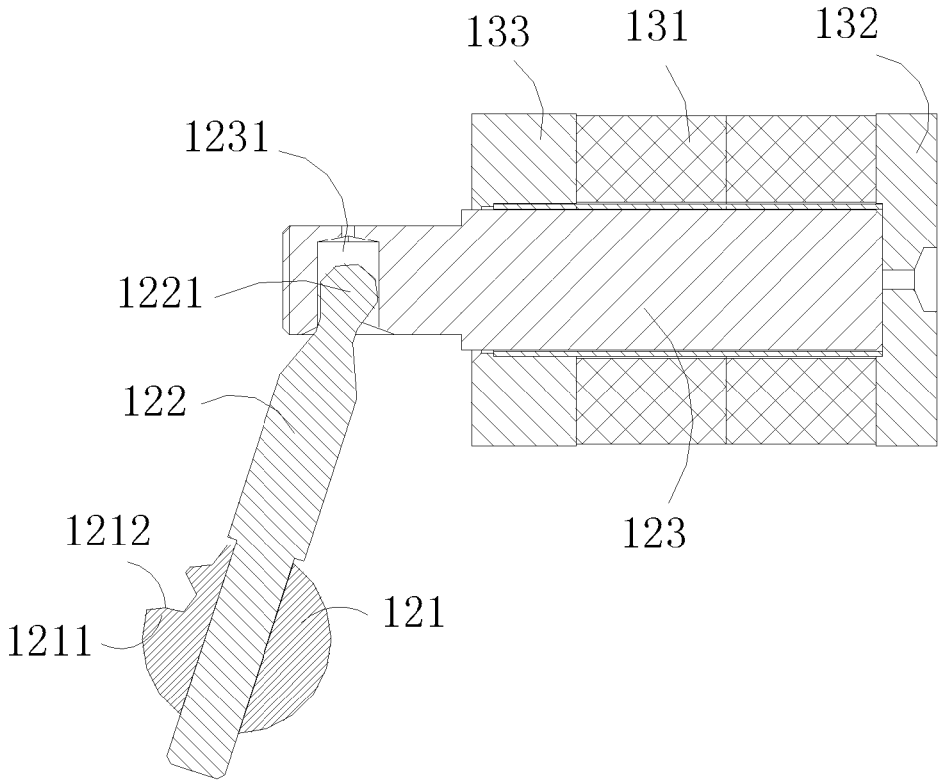
FIG. 8 schematically shows a state of being attracted together of FIG. 7.

With reference to FIGS. 1-5, the present invention discloses a contactor 100, including one or more phase units 110, a mechanical drive 120 controlling the phase unit 110 and an electronic control module 130 driving the mechanical drive 120.

The phase unit 110 includes an independent insulating housing 111, and, inside the housing, a positive pole 112, a static conducting rod 113 connected to the positive pole 112, a negative pole 114, a moving conducting rod 115 connected to the negative pole 114 and a counter-force elastic component 116 driving the moving conducting rod 115 to reset.

The mechanical drive 120 includes a central shaft 121 which passes through the insulating housings 111 of the one or more phase units and drives all the moving conducting rods 115 to electrically contact the static conducting rod 113 at the same time, and a transmission which controls the rotation of the central shaft 121. The electronic control module 130 drives the transmission.

The electronic control module 130 drives the transmission to move, the transmission drives the central shaft 121 to rotate, the central shaft 121 drives the moving conducting rod 115 and the static conducting rod 113 to be attracted together, and the central shaft 121 passes through the insulating housings 111 of the one or more phase units 110 and drives each of the phase units 110, so as to make the contactor 100 be formed by absolutely independent phase units 110 and convenient to increase the rated operational current by adding phase units 100 along the central shaft 121.

The transmission includes a drive rod 122 for driving the central shaft 121 to rotate and a magnetic pole core 123 movably connected to the drive rod 122. The electronic control module 130 includes an inductance coil 131 for driving the magnetic pole core 123 to perform straight reciprocating motion.

With reference to FIGS. 1-4, in the illustrated embodiment of the present invention, the contactor 100 is a three-phase contactor with a rated operational current of up to 400 A. In the embodiment, the inductance coil 131 drives the magnetic pole core 123 to perform straight reciprocating motion in the horizontal direction. The drive rod 122 is driven by the magnetic pole core 123 to swing side to side. The drive rod 122 drives the central shaft 121 to rotate either clockwise or anti-clockwise within a pre-set angle.

Preferably, the electronic control module 130 further includes a first fixing plate 132 and a second fixing plate 133 which is disposed opposite to the first fixing plate 132. The magnetic pole core 123 passes through the second fixing plate 133 and is inserted in the inductance coil 131.

Preferably, the electronic control module 130 further includes a first fixing plate 132 and a second fixing plate 133 which is disposed opposite to the first fixing plate 132. The magnetic pole core 123 passes through the second fixing plate 132 and is inserted in the inductance coil 131.

Preferably, a recess 1231 is provided in one end of the magnetic pole core 123. A joint 1221 which is movable in the recess 1231 is provided at one end of the drive rod 122, and the other end of the drive rod 122 is fastened to the central shaft 121.

Preferably, the central shaft 121 is provided with a tooth-like portion 1211. The tooth-like portion 1211 is provided with a tooth face 1212 which is floated with the rotation of the central shaft 121. The phase unit 110 also includes a spring chamber 117 provided with a tooth 1171. The tooth-like portion 1211 of the central shaft 121 cooperates with the tooth 1171 and drives the spring chamber 117 to float. The spring chamber 117 is connected to the drive rod 115 and drives the moving conducting rod 115 to float. Once the moving conducting rod 115 floats upward, it will be attracted to engage with the static conducting rod 113.

The counter-force elastic component 116 is a counter-force spring. One end of the counter-force spring contacts with the insulating housing 111. The other end of the counter-force spring contacts with a hook portion 1172, which extends from the spring chamber 117 and is able to compress the counter-force spring and resets when the counter-force spring bounces.

The phase unit 110 also includes a conducting wire 118 for connecting the moving conducting rod 115 and the negative pole 114, and a vacuum conducting chamber 119 for providing a contacting environment for the static conducting rod 113 and the moving conducting rod 115.

When there are multiple phase units 110, such as three as in the above embodiment, the central shaft 121 passes through all the phase units 110. The mechanical drive 120 provides a drive rod 122 and a magnetic pole core 123 between every two phase units 110. The electronic control module 130 is provided with an inductance coil 131 corresponding to each magnetic pole core 123. So it can ensure all the phase units 110 being driven at the same time, with guaranteeing to have enough power and stability.

The contactor 100 also includes a base 140. The phase units 110 are arranged on the base 140, and the electronic control module 130 is mounted on the base 140 and placed on a side of the phase units 110. Because every phase units 110 are absolutely independent to each other, the number of the phase units 110 can be added or reduced simply, and when a certain phase unit 110 needs to be repaired, it can be conveniently repaired or even replaced.

Referring to FIGS. 5-8, the working principle of the contactor 100 is as follows: In the beginning, the positive pole 112 and the negative pole 114 of each phase unit 110 of the contactor 100 are both in a disconnected state. In the work state, the inductance coil 131 is electrified and then creates a magnetic field which attracts the magnetic pole core 123, then, the magnetic pole core 123 moves to the inductance coil 131 and drives the drive rod 122 to swing. The swinging of the drive rod 122 drives the central shaft 121 to rotate clockwise (see FIG. 5), and after the rotation of the central shaft 121, the tooth-like portion 1211 rotates together with the central shaft so as to raise the tooth face 1212 from the initial height to the engagement height, that is, to raise a certain height at the vertical direction, then the tooth-like portion 1211 matches the tooth 1171 of the spring chamber 117, the tooth face 1212 drives the spring chamber 117 to move upward, so as to drive the moving conducting rod 115 to move upward and finally contact with the static conducting rod 113, and then, the positive pole 112 will be connected to the negative pole 114. Because the central shaft 121 passes through every phase units 110 and matches the spring chambers 117 of all the phase units 110, when the central shaft 121 rotates, every spring chambers 117 can be raised, so as to make the positive poles 112 and the negative poles 114 of all the phase units 110 be connected at the same time.

When the inductance coil 131 is power off, the magnetic pole core 123 does not have a magnetic field force, then the magnetic pole core 123 does not have a magnetic force for attracting to make the central shaft 121 drive the drive rod 113, which causes the force from the tooth face 1212 to the spring chamber 117 to be disappeared, and the counter-force spring, since no force is applied thereto for compressing, begins to bounce, and then causes the spring chamber 117 to fall downward. The falling of the spring chamber 117 in turn acts on the tooth face 1212 to force the central shaft 121 to rotate in a reverse direction, i.e. by anticlockwise, and force the drive rod 122 to swing in a reverse direction to make the magnetic pole core 123 to be drawn out from the inductance coil 131 and return back to its initial state. The falling of the spring chamber 117 brings the moving conducting rod 115 to fall, so as to separate the moving conducting rod 115 and the static conducting rod 113, and finally make the positive pole 112 and the negative pole 114 to be disconnected.

Figure 9:
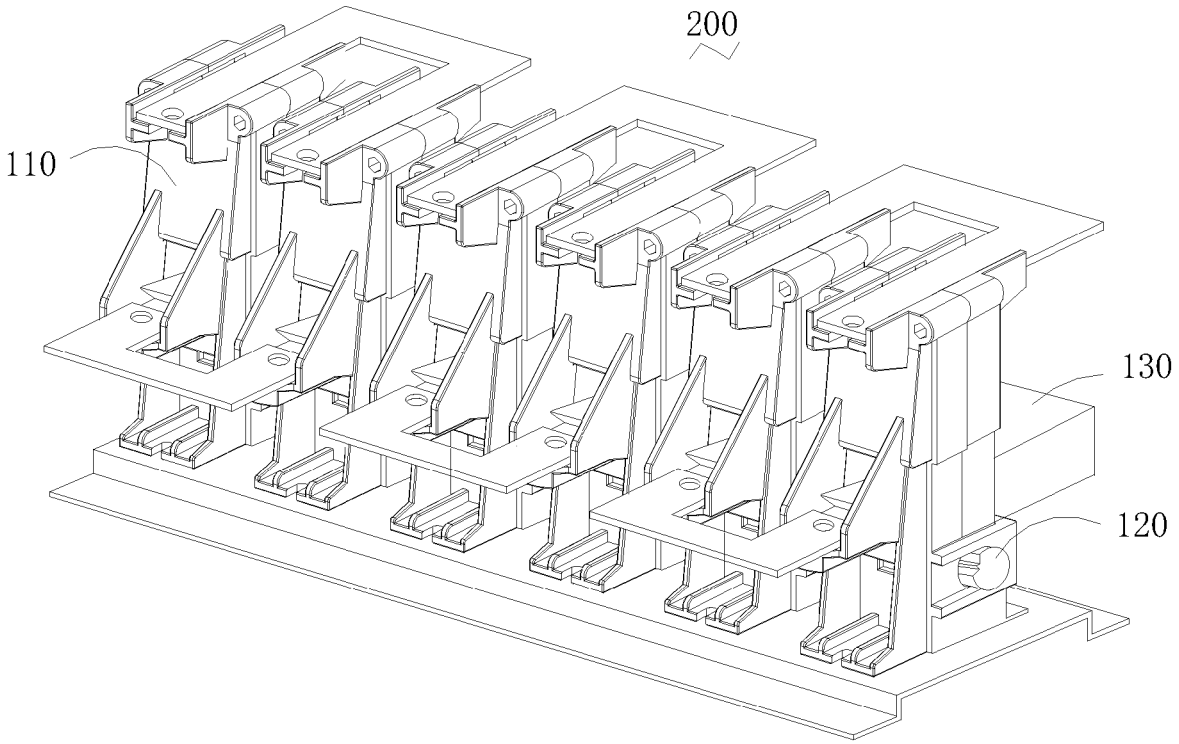
FIG. 9 shows a perspective view of a contactor according to another embodiment of the present invention.

The insulating housings 111 of every phase units 110 are absolutely independent from each other, and can be driven by the central shaft 121 at the same time. In theory, the central shaft 121 can be extended indefinitely, the number of the phase units can be increased indefinitely, and it is convenient to repair and replace any phase unit 110. Meanwhile, the working current can be increased by paralleling multiple phase units 110. As shown in FIG. 9, the contactor 200 is a three-phase contactor; each phase is composed of two phase units 110 connected in parallel, so that the rated current of the three-phase contactor can be up to 800 A. The rated current of the three-phase contactor can be up to 1200 A by setting each phase as being composed of three phase units 110 connected in parallel. Furthermore, the rated current can be higher by parallel arranged. A contactor with various kinds of rated current can be formed by setting the central shaft 121 and increasing or reducing phase units 110, so as to solve the problem that the housing of the traditional contactor is a whole and it is difficult to increase the rated current and make repairing or replacing work.

Though the invention has been described in terms of various specific embodiments, those skilled in the art will recognize that the invention can be practiced with modification within the spirit and scope of the claims.

What is claimed is:

1. A contactor, comprising:

one or more phase units, a mechanical drive controlling the one or more phase units; and an electronic control module for driving the mechanical drive;

wherein each phase unit comprises an independent insulating housing, and, inside the housing, a positive pole, a static conducting rod connected to the positive pole, a negative pole, a moving conducting rod connected to the negative pole and a counter-force elastic component for driving the moving conducting rod to reset;

the mechanical drive comprises a central shaft which passes through the insulating housings of the one or more phase units and drives all the moving conducting rods to electrically contact the static conducting rod, and a transmission which controls the rotation of the central shaft, wherein the transmission comprises a drive rod for driving the central shaft to rotate and a magnetic pole core movably connected to the drive rod;

the electronic control module drives the transmission, wherein the electronic control module comprises an inductance coil for driving the magnetic pole core to perform straight reciprocating motion.

2. The contactor of claim 1 , wherein the inductance coil drives the magnetic pole core to perform straight reciprocating motion in horizontal direction, the magnetic pole core drives the drive rod to swing side to side, and the drive rod drives the central shaft to rotate either clockwise or anticlockwise within a pre-set angle.

3. The contactor of claim 1 , wherein the electronic control module further comprises a first fixing plate and a second fixing plate which is disposed opposite to the first fixing plate, the inductance coil is disposed between the first and second fixing plates, the magnetic pole core passes through the second fixing plate and is inserted in the inductance coil.

4. The contactor of claim 1, wherein a recess is provided in an end of the magnetic pole core, a joint which is movable in the recess is provided at one end of the drive rod, and the other end of the drive rod is fastened to the central shaft.

5. The contactor of claim 1, wherein the central shaft is provided with a tooth-like portion which has a tooth face capable of floating with the rotation of the central shaft, the phase unit further comprises a spring chamber provided with a tooth, the tooth-like portion of the central shaft cooperates with the tooth and drives the spring chamber to float, the spring chamber is connected to the moving conducting rod and drives the moving conducting rod to float.

6. The contactor of claim 5, wherein the counter-force elastic component is a counter-force spring which has one end contacting the insulating housing and the other end being held against a hook portion extending from the spring chamber, wherein the hook portion is able to compress the counter-force spring and reset when the counter-force spring bounces.

7. The contactor of claim 1, wherein the contactor comprises a plurality of phase units, the central shaft passes through every phase units, the mechanical drive is provided with drive rods and magnetic pole cores respectively corresponding to each of the phase units, the electronic control module is provided with inductance coils respectively corresponding to each of the magnetic pole cores.

8. The contactor of claim 7, wherein the contactor further comprises a base, the phase units are mounted on the base, and the electronic control module is mounted on the base and located on one side of the phase units.

9. The contactor of claim 7, wherein the plurality of phase units form a three-phase contactor, wherein each phase comprises at least two phase units connected in parallel.

* * * * *

UNITED STATES PATENT AND TRADEMARK OFFICE

CERTIFICATE OF CORRECTION

PATENT NO. : 8,970,330 B2
APPLICATION NO. : 14/032189
DATED : March 3, 2015
INVENTOR(S) : Zhiming Wu, Yihan Xu and John Bin Zhan It is certified that error appears in the above-identified patent and that said Letters Patent is hereby corrected as shown below:

Title page

Insert --(30) Foreign Application Priority Data
Sep. 20, 2012 CN ..... 201210352826.5--.

Signed and Sealed this
Eighth Day of September, 2015

Michelle K. Lee

Michelle K. Lee
*Director of the United States Patent and Trademark Office*